US005337470A

United States Patent [19]

Hoffman et al.

[11] Patent Number: 5,337,470

[45] Date of Patent: Aug. 16, 1994

[54] METHOD AND APPARATUS FOR REMOVING A NOZZLE INSERT FROM A STEELMAKING LADLE

[75] Inventors: John P. Hoffman, Coopersburg; Alvin M. Nestler, Hellertown, both of Pa.; Edward T. Witek, Hobart; Donald J. Idstein, Valparaiso, both of Ind.

[73] Assignee: Bethlehem Steel Corporation, Bethlehem, Pa.

[21] Appl. No.: 53,924

[22] Filed: Apr. 26, 1993

Related U.S. Application Data

[63] Continuation-in-part of Ser. No. 25,543, Mar. 3, 1993.

[51] Int. Cl.[5] ..... B23P 19/00

[52] U.S. Cl. ..... 29/426.5; 29/252; 29/261

[58] Field of Search ..... 29/252, 261, 266, 426.4, 29/426.5

[56] References Cited

U.S. PATENT DOCUMENTS

| | | | |
|---|---|---|---|
| 766,753 | 8/1904 | Brooks | 29/252 |
| 1,331,305 | 2/1920 | Wilkinson, Jr. | 29/252 |
| 1,403,589 | 1/1922 | Cinqini | 29/252 |
| 1,581,057 | 4/1926 | Hill | 29/252 |
| 1,601,321 | 9/1926 | Picos | 29/252 |
| 1,692,274 | 11/1928 | Malloy et al. | 29/252 |
| 2,561,577 | 7/1951 | Knudsen | 29/252 |
| 2,566,637 | 9/1951 | Roberts | 29/244 |
| 2,697,872 | 12/1954 | Armstrong | 29/252 |
| 3,069,761 | 12/1962 | Sommer | 29/252 |
| 3,337,943 | 8/1967 | Powell | 29/252 |
| 3,458,918 | 8/1969 | Kitajima et al. | 29/239 |
| 3,491,428 | 1/1970 | Kerin | 29/252 |
| 4,283,826 | 8/1981 | Miller | 29/426.5 X |
| 4,355,450 | 10/1982 | Miller | 29/426.5 |
| 4,571,802 | 2/1986 | Calhoun et al. | 29/157.3 |
| 4,754,539 | 7/1988 | Knoll et al. | 29/252 X |
| 4,959,899 | 10/1990 | Martin | 29/252 X |
| 5,040,278 | 8/1991 | Eckold et al. | 29/252 X |

*Primary Examiner*—Mark Rosenbaum
*Assistant Examiner*—S. Thomas Hughes
*Attorney, Agent, or Firm*—Harold I. Masteller, Jr.

[57] ABSTRACT

A nozzle extraction tool for removing a worn nozzle insert from a steelmaking vessel. The nozzle extraction tool including a support frame, a gripper assembly, and a drive piston for applying a force to the gripper assembly. The gripper assembly includes pivotal gripper arms and a rod assembly for pivoting and rotating the gripper assembly 360° about the longitudinal axis of the worn nozzle insert. The rod assembly enables the gripper arms to be securely seated against the uneven surfaces of the worn discharge bore extending through the nozzle insert.

21 Claims, 4 Drawing Sheets

Fig. 1
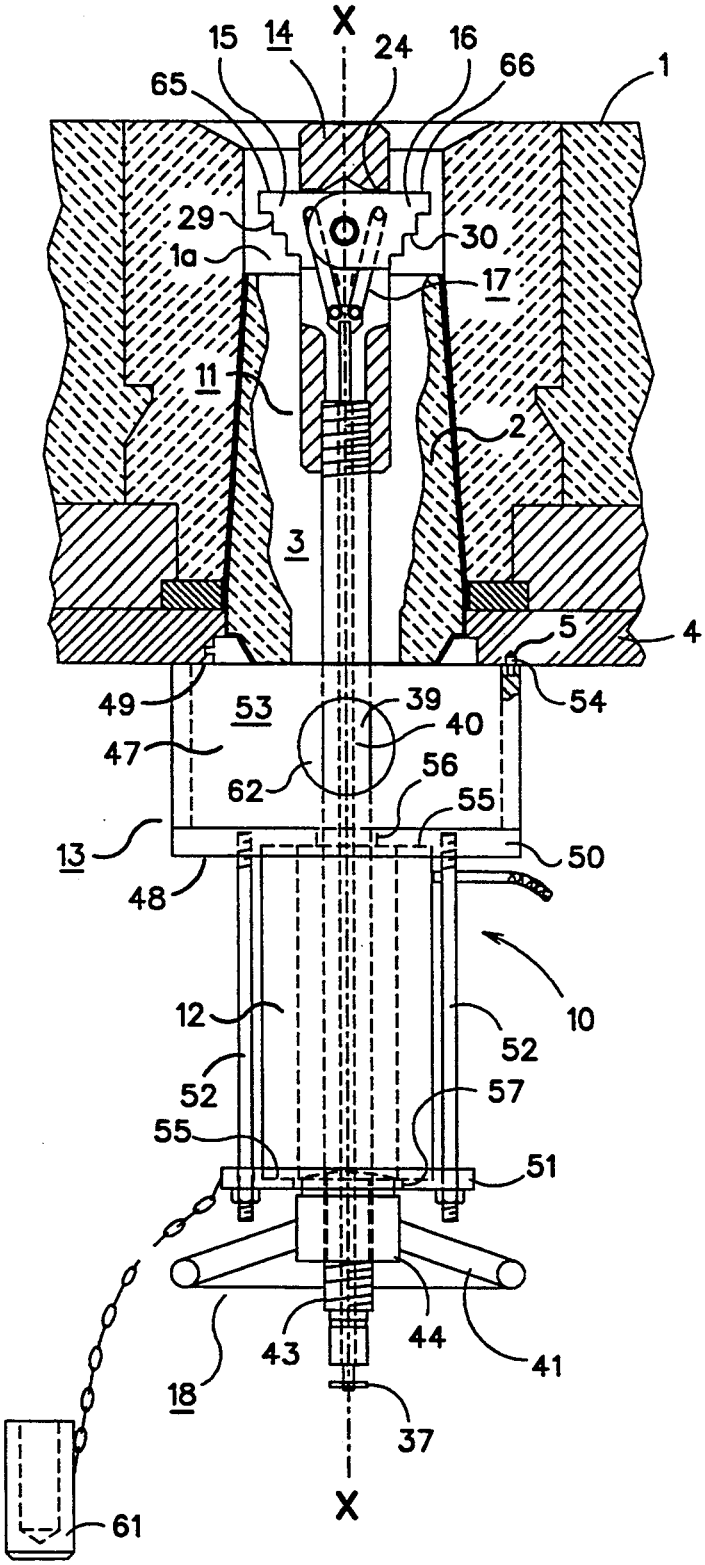
Fig. 2
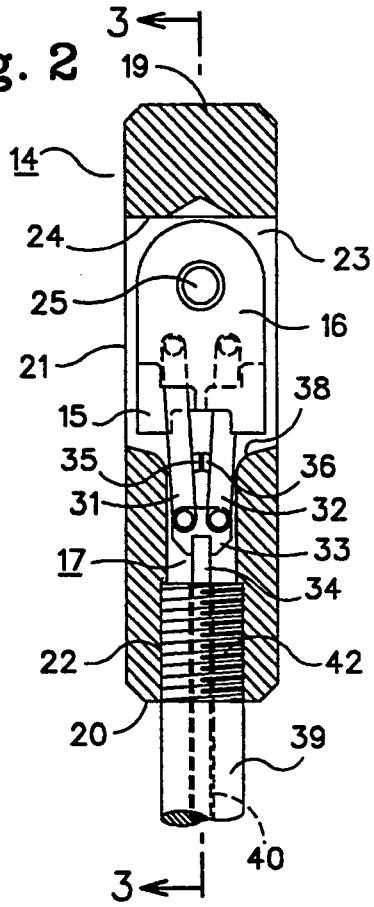
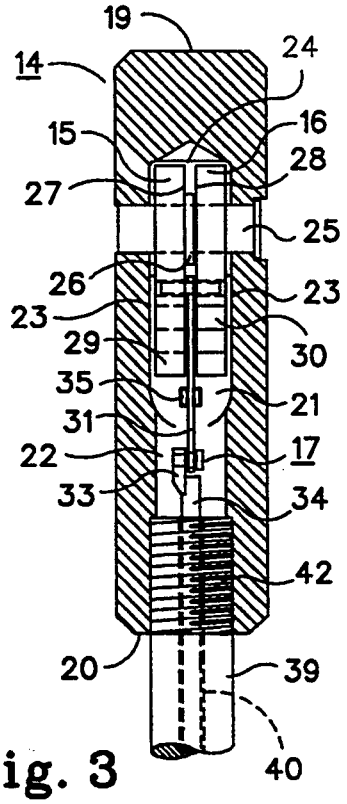
Fig. 3

METHOD AND APPARATUS FOR REMOVING A NOZZLE INSERT FROM A STEELMAKING LADLE

This application is a continuation-in-part of application Ser. No. 08/025,543 filed Mar. 3, 1993.

BACKGROUND OF THE INVENTION

This invention relates to nozzle inserts and in particular to extraction tools for removing nozzle inserts from the discharge bore of a steelmaking ladle. After repeated use in steelmaking vessels, nozzle inserts become eroded to a point where they are no longer useful, and they must be replaced. The mortar bond between the nozzle insert and the discharge bore of the steelmaking ladle makes replacement of the insert difficult and time-consuming. In the past, jack hammer like tools were used to chip away the worn insert to remove it from the ladle. This violent hammering action often damaged the adjacent refractory lining of the ladle making extensive repairs necessary before the ladle could be brought back into service.

SUMMARY OF THE INVENTION

It is therefore an object of this invention to provide a nozzle extraction tool which simplifies the removal of a worn nozzle insert from the discharge bore of a ladle.

It is a further object of this invention to provide a nozzle extraction tool which will either eliminate or greatly reduce damage to the surrounding refractory lining as the worn nozzle insert is removed from the ladle.

It is still a further object of this invention to provide a nozzle extraction tool having pivotal gripping means for frictionally engaging the worn surface of a nozzle insert.

And finally, it is an object of this invention to provide a method for removing a worn two piece refractory/steel nozzle insert from a steelmaking ladle.

We have discovered that the foregoing objects can be attained with a nozzle extraction tool having a support frame, a gripper assembly, and a drive means for applying a force to the gripper assembly. The gripper assembly includes gripper arms capable of being pivoted and rotated to engage the worn nozzle insert.

BRIEF DESCRIPTION OF THE DRAWINGS

FIG. 1 is a cross-sectional view of the preferred embodiment of the nozzle insert ladle extraction tool.

FIG. 2 is a enlarged cross-sectional view of a portion of the gripper assembly.

FIG. 3 is a enlarged cross-sectional view taken along the lines 3—3 of FIG. 2.

DETAILED DESCRIPTION OF THE PREFERRED EMBODIMENT

Figures 4, 5, 6, 7, 8:
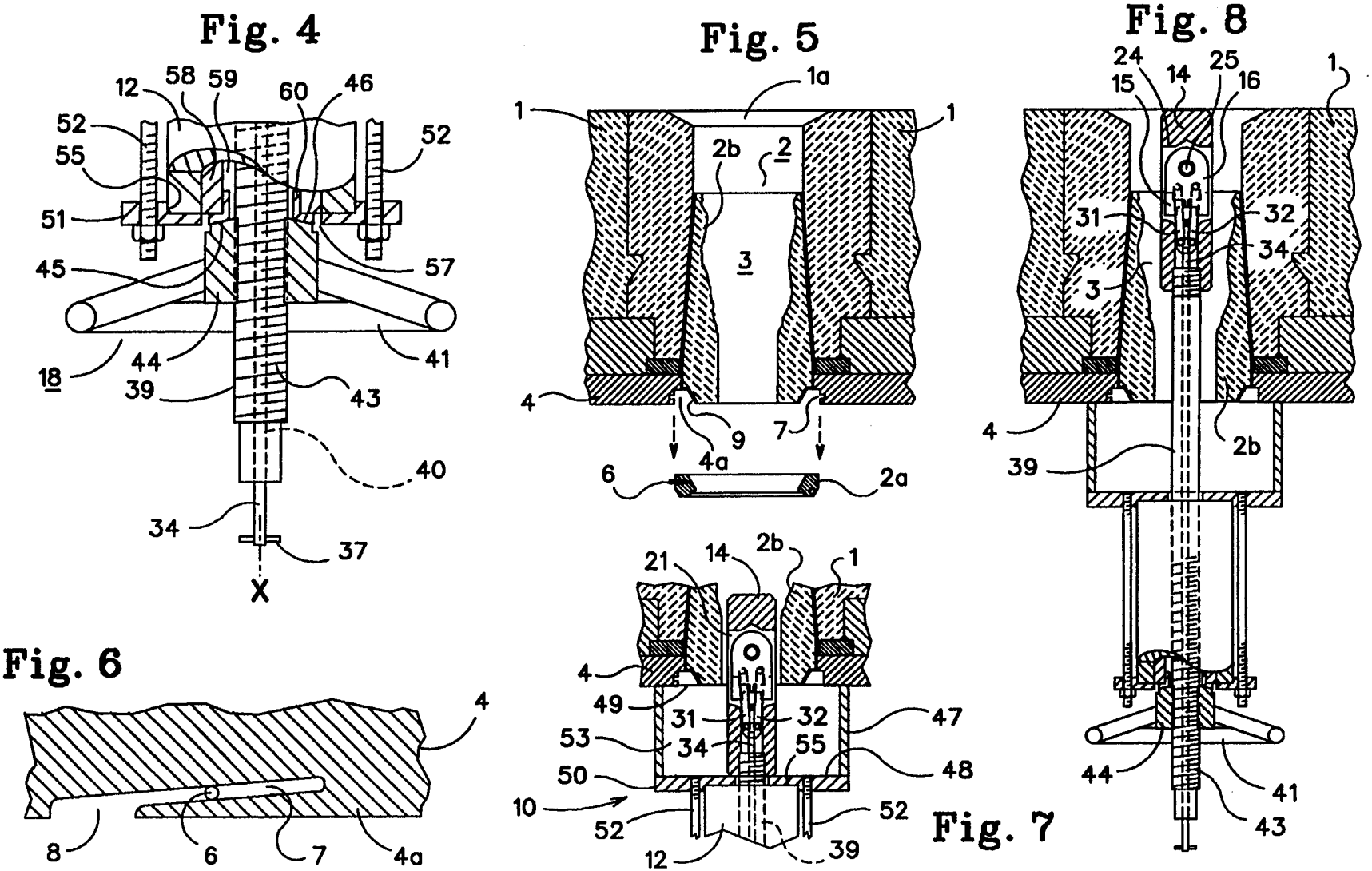
FIG. 4 is a enlarged cross-sectional view of the gripper assembly pivot means.
FIG. 5 is a cross-sectional view of a ladle and nozzle insert.
FIG. 6 is a enlarged cross-sectional portion of FIG. 5.
FIGS. 7–11 are cross-sectional views showing steps for extracting a worn nozzle insert.

Referring to FIGS. 1–3 of the drawings, a nozzle extraction tool 10 is shown positioned adjacent a worn nozzle insert 2 positioned within the discharge bore 1a of a steelmaking ladle 1. The nozzle extraction tool 10 comprises a gripper assembly 11, a power drive 12, for applying a force to the gripper assembly, and a support frame 13.

Gripper assembly 11 includes an elongated housing 14, gripper arms 15 and 16, for engaging the worn discharge bore 3 of nozzle insert 2, linkage 17, for rotating the gripper arms to their opened or closed positions, and a gripper adjustment means 18, for positioning gripper arms 15 and 16 within the worn discharge bore 3.

As shown more clearly in FIGS. 2 and 3, the elongated housing 14 includes a first end 19, a second end 20, a slot 21 extending through housing 14, and a bore 22 extending between the second end 20 and slot 21. Slot 21, defined by sidewalls 23 and upper surface 24, forms an inside chamber adapted to house gripper arms 15 and 16.

Gripper arms 15 and 16 are pivotally attached to sidewalls 23 by means of a pivot pin 25 inserted through apertures provided in each sidewall 23. A bushing 26 is positioned between adjacent gripper arm surfaces 27 and 28 to provide access for linkage 17. Surfaces 27 and 28 each include an aperture for pivotally fastening linkage 17 to the gripper arms, and gripper arms 15 and 16 further include serrations 29 and 30 for engaging the uneven worn surfaces of the discharge bore 3 extending through the nozzle insert.

Linkage 17 provides means for rotating gripping arms 15 and 16 to their opened and closed positions. The linkage includes a pair of link straps 31 and 32, a link plate 33, and a push rod 34. One end of link strap 31 is pivotally attached to gripper arm 15 by means of a pin inserted into the aperture provided within surface 27, and the opposite end of link strap 31 is pivotally attached to link plate 33 by means of a pivot pin inserted into an aperture provided within the link plate. Likewise, one end of link strap 32 is pivotally attached to gripper arm 16 by means of a pin inserted into the aperture provided within surface 28, and the opposite end of link strap 32 is pivotally attached to link plate 33 by means of a pivot pin inserted into an aperture provided within the link plate.

Linkage 17 further includes a stop means to limit rotation of the gripper arms 15 and 16 in the closed direction. The stop means comprises a first bar 35 fastened to link strap 31, and a second bar 36 fastened to link strap 32. As shown in FIG. 2, bars 35 and 36 are positioned to strike each other as the gripper arms are rotated to a predetermined closed position. Likewise, the upper surface 24, of slot 21, provides a stop means to limit rotation of gripper arms 15 and 16 in the open direction. As shown in FIG. 1, gripper arms 15 and 16 include edges 65 and 66 which strike surface 24 as the gripper arms are rotated to a predetermined open position.

Figure 12:
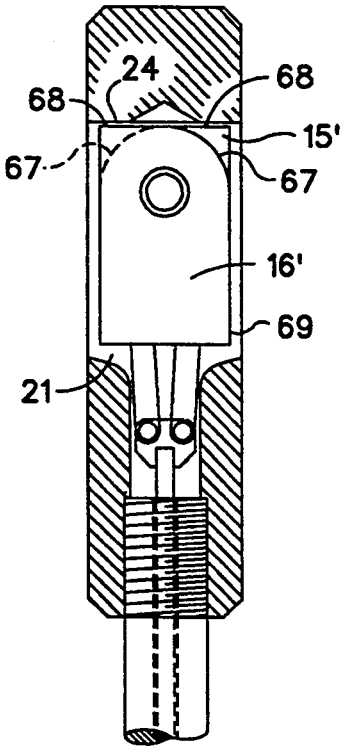
FIG. 12 is a cross-sectional view of an alternate embodiment of the gripper assembly shown in FIG. 2.
Figure 13:
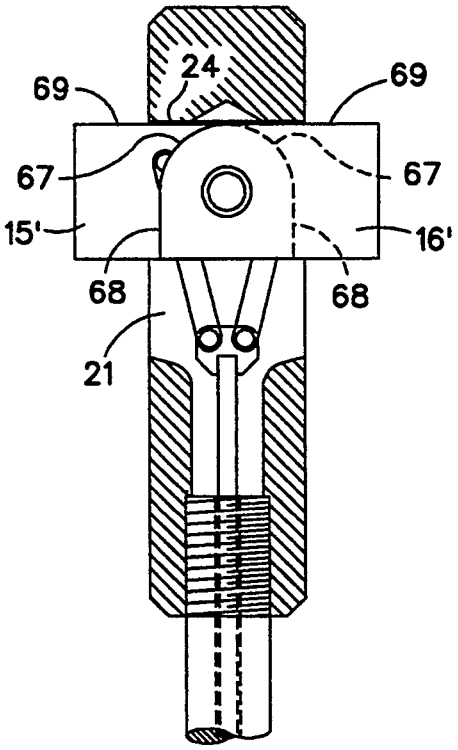
FIG. 13 is a view similar to FIG. 12 showing the gripper assembly in its opened position.

An alternate gripper arm embodiment is shown in FIGS. 12 and 13. This alternate embodiment includes two or more substantially rectangular shaped gripper arms 15' and 16'. Each gripper arm includes a chamfered comer 67, a first edge portion 68 tangent to chamfer 67, and a second edge portion 69 also tangent to chamfer 67. The chamfered corner provides clearance for rotating the gripper arms within the chamber of housing 14, and edges 68 and 69 provide stop means to prevent rotating the gripper arms beyond their opened and closed positions.

Each edge 68 provides a stop means for its respective gripper arm by striking the upper surface 24 of slot 21 as the gripper arm is rotated to its closed position. Likewise, each edge 69 provides a stop means by striking upper surface 24 as its gripper arm is rotated to the opened position. Edges 68 and 69 are shown positioned at a 90° angle to each other. However, it should be understood the edges 68 and 69 can be positioned at any angle without departing from the scope of this invention.

Push rod 34, of linkage 17, extends through both bore 22 of housing 14, and a conduit 40 within the gripper adjustment means 18. One end of push rod 34 is fastened to link plate 33 and the opposite end, which includes a handle 37, extends to an outlying position from the gripper adjustment means. Push rod 34 provides means for applying a force to linkage 17 to rotate gripper arms 15 and 16 to either their opened or closed positions. As rod 34 is pushed toward the ladle, link straps 31 and 32 are forced in an outward direction, and the gripper arms are rotated to the predetermined open position against upper surface 24. Conversely, as the push rod is pulled from conduit 40, the link straps are forced in an inward direction and gripper arms 15 and 16 are rotated to the predetermined closed position within the inside chamber formed by slot 21. Bore 22 communicates with slot 21 and includes a rounded shoulder portion 38 to guide the linkage and gripper arms into their closed positions within the inside chamber.

Referring also to FIG. 4, the gripper adjustment means 18 comprises an elongated hollow rod or pipe 39, and a handwheel 41. Rod 39 forms the linkage conduit 40 heretofore described and comprises a first end 42 threaded into bore 22 of the housing, and a second end having a threaded portion 43 for receiving hub 44 of the handwheel. Hub 44 includes a ball shaped end 45 adapted to engage a socket 46 formed within the drive means 12. As shown in the drawings, gripper assembly 11 is attached to one end of rod 39. The opposite end of rod 39 includes a threaded portion which passes through an enlarged aperture provided in socket 46 and engages the threads of an aperture extending through hub 44. The ball and socket connection provides means to pivot and/or rotate gripper assembly 11 about the X—X axis of the nozzle extraction tool.

Figure 9:
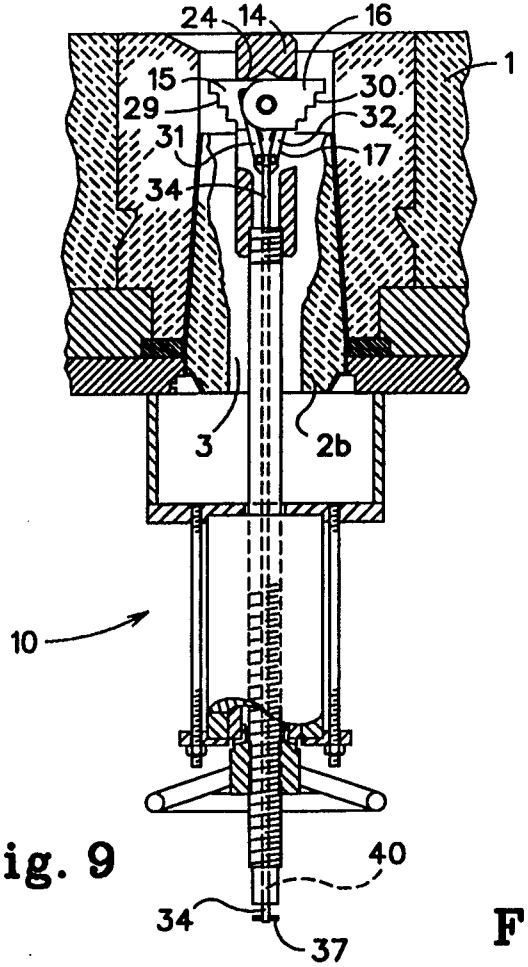

The gripper arms of gripper assembly 11 can be rotated to any point about the X—X axis to engage a selected portion of the nozzle insert, and the pivotal movement of gripper assembly 11 can occur at any point about the X—X axis. For example, after gripper arms 15 and 16 have been extended to their open position as shown in FIGS. 1, 9 and 13, it may be desirable to rotate gripper assembly 11 about the X—X axis to align gripper arms 15 and 16 with a less eroded portion of nozzle insert 2. In such cases threaded rod 39 can be rotated within the threaded aperture of hub 44 and the gripper arms rotate about the X—X axis for alignment with a selected portion of the nozzle insert. After the gripper arms have been aligned with nozzle insert 2, handwheel 41 is turned in a direction to engage gripper arms 15 and 16 with the nozzle insert 2, and ball end 45 of hub 44 engages socket 46.

Unequal distribution of the gripping forces can develop as gripper arms 15 and 16 engage the worn surfaces of nozzle insert 2. For example, gripper arm 15 may engage the nozzle insert before gripper arm 16 makes contact. Ball 45 will then pivot within socket 46, and rod 39, captured within the threaded aperture of hub 14, is forced to follow the motion of the hub, and the gripper assembly pivots about the X—X axis until both gripper arms engage the nozzle. The enlarged aperture extending through socket 46 provides clearance for the gripper assembly to pivot. This pivoting action can take place intermittently, whenever the gripping forces become unequal due to either the arms slipping or the nozzle refractory splintering under the pressure developed during the extraction process.

As shown in FIG. 1, support frame 13, positioned adjacent mounting plate 4 of the steelmaking ladle 1, includes a tubular member 47, a fast cylinder end cap 50, a second cylinder end cap 51, and tie rods 52 extending between the first and second cylinder end caps 50 and 51. Each end cap 50 and 51 includes a cylinder seat 55 for securing the opposite ends of power drive 12. The end caps, along with tie rods 52, form a clamp arrangement to hold and support drive means 12 between the tubular member 47 and the ball end 45 of the hub. The first cylinder end cap 50 includes an aperture 56 through which rod 39 of the gripper adjustment means extends, and the second cylinder end cap 51 includes an aperture 57 to accommodate drive means 12.

The tubular member includes an open end 49, encircling the discharge bore 1*a* of the ladle, and a closed end 48. The fast cylinder end cap 50 provides a cover for closed end 48 and forms a container 53 for receiving extracted worn nozzle inserts 2. Open end 49 includes a plurality of alignment pins 54 for engagement with apertures 5 within mounting plate 4. Alignment pins 54, and corresponding apertures 5, are arranged to coaxially align nozzle extraction tool 10 and the worn nozzle insert.

Figure 14:
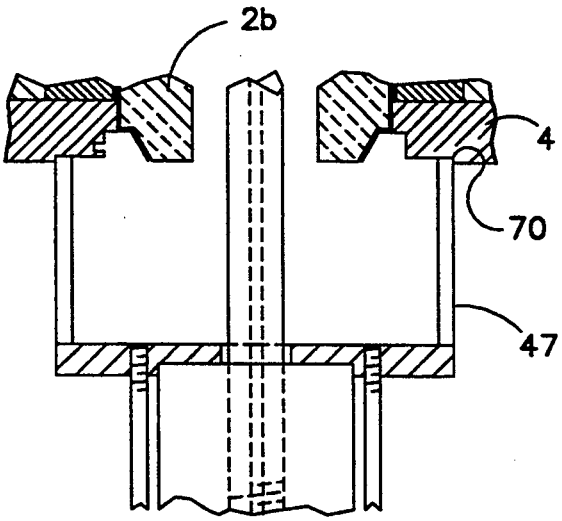
FIG. 14 is a cross-sectional view of an alternate embodiment for aligning the extraction tool with a nozzle bore.
Figure 15:
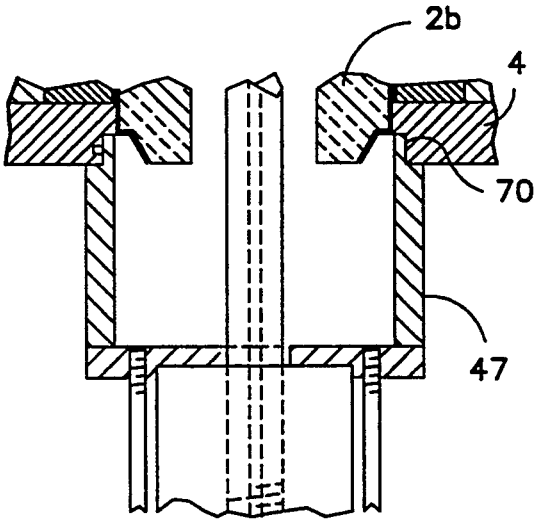
FIG. 15 is still another alternate embodiment for aligning the extraction tool with a nozzle bore.

Alternate alignment embodiments, shown in FIGS. 14 and 15, include a recessed shoulder 70 formed within mounting plate 4. Shoulder 70 is shaped to conform with the periphery of tubular member 47 and thereby provide a seat to coaxially align the extraction tool with the worn nozzle insert.

Referring again to FIG. 4, drive means 12 is a double acting, hollow plunger design, hydraulic cylinder. The hollow plunger 58 provides a passageway 59 for rod 39, and one end of plunger 58 includes a bushing 60 in which socket 46 is formed for receiving ball 45 of hub 44. Handwheel 41 is rotated about threads 43 to engage the ball and socket connection, and hub 44 can be rotated about the X—X axis to provide alignment of gripper arms 15 and 16 of the gripper arm assembly with suitable portions of the worn nozzle insert. As handwheel 41 is further rotated, forcing rod 39 in a direction away from the steelmaking ladle, the opened gripper arms 15 and 16 are pulled into the worn discharge bore of the nozzle insert. Serrated edges 29 and 30 of the gripper arms engage the uneven worn surfaces of bore 3, and ball 45 is free to pivot within socket 46 to provide means to pivot gripper assembly 11 about the X—X axis of the extraction tool. This pivoting motion allows gripper assembly 11 to pivot at any point about the X—X axis and securely seat the serrated edges against the worn surfaces of the discharge bore.

Referring once again to FIG. 1, an impact cap 61 is provided for placement over the threaded portion 43 of rod 39. Impact cap 61 provides protection for the adjustment end of the extraction tool in the event it becomes necessary to drive the gripper arms from their seated position within discharge bore 3. A sight hole 62 is also provided to allow an operator to look into container 53 to determine when the worn nozzle is fully extracted from the ladle bore 1*a*.

Referring now to FIGS. 5–11 of the drawings, the preferred nozzle extraction tool is particularly suited for removing worn refractory/steel nozzle inserts as described and claimed in copending U.S. patent application 08/025,543. The refractory/steel nozzle 2 comprises a steel lockring portion 2*a* having lock pins 6 which engage circumferential grooves 7 within a bore 4*a* of mounting plate 4, and a refractory portion 2*b* inserted within the discharge bore l*a* of ladle 1.

As shown in FIGS. 5 and 6, to remove a two piece refractory/steel nozzle insert from a steelmaking ladle, lockring 2*a* must first be rotated within bore 4a to break a mortar bond 9 between the steel lockring and the refractory portion 2*b*. Lockring 2a is then further rotated until lock pins 6, captured within grooves 7, are aligned with apertures 8. The steel lockring 2*a* is then pulled from the mounting plate bore. A wrench type tool may be used to apply force for rotating and removing the steel lockring portion of the two piece insert.

Referring to FIG. 7, before positioning the nozzle extraction tool to remove the worn refractory portion 2*b* of the nozzle insert, handwheel 41 is rotated to place housing 14 within container 53, and push rod 34 is pulled outward to rotate gripper arms 15 and 16 to their closed positions within the inside chamber provided by slot 21. With the gripper assembly and gripper arms in their retracted and closed positions, the nozzle extraction tool 10 is placed adjacent mounting plate 4 with the open end 49 encircling discharge bore of the steelmaking ladle. The nozzle extraction tool is then coaxially aligned with the worn refractory portion 2*b* by inserting alignment pins 54 into apertures 5 as shown in FIG. 1. The nozzle extraction tool may include means for fastening crane hooks or the like to assist in lifting and aligning the tool.

As shown in FIGS. 8 and 9, with the nozzle extraction tool coaxially aligned with the worn refractory portion, handwheel 41 is rotated to advance gripper assembly 11 toward the ladle and into the worn discharge bore 3. The closed gripper arms 15 and 16 are positioned to engage the nozzle insert, and push rod 34 is pushed toward ladle 1 forcing link straps 31 and 32 to pivot outward. The outward movement of the link straps forces the gripper arms to rotate in an upward direction about pivot pin 25 until they reach their predetermined open position against upper surface 24. Serrations 29 and 30 are now extended to engage the uneven surfaces of the worn discharge bore 3.

Figure 10:
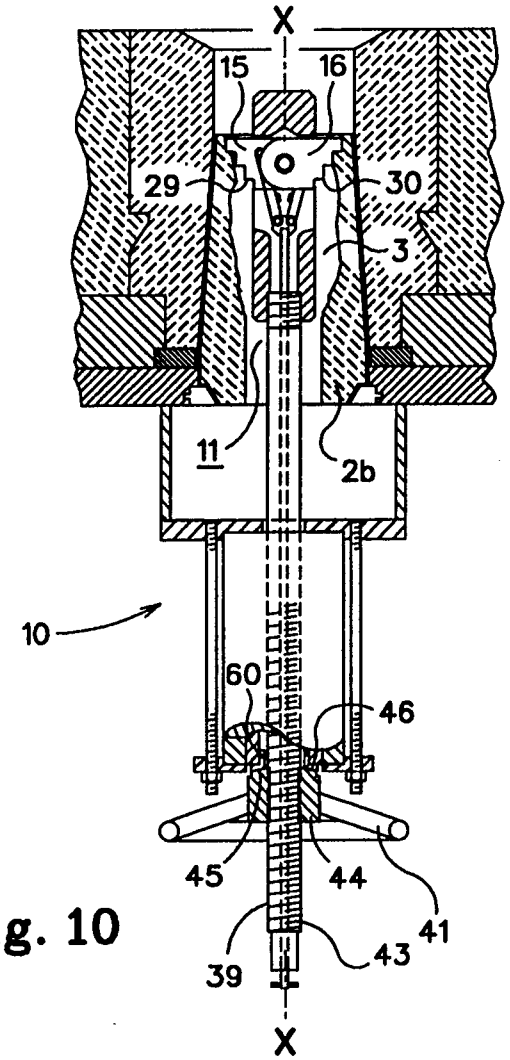

Referring to FIGS. 10 and 15 of the drawings, after the gripper arms have been extended to their open position, they may be rotated 360° about the X—X axis, as heretofore described, to align the gripper arms with selected portions of the worn nozzle surface. Handwheel 41 is rotated to move the gripper assembly 11 in a direction away from the steelmaking ladle. The gripper arms 15 and 16 are drawn into the worn bore 3, and the serrated edges 29 and 30 engage the uneven surfaces of the worn bore. As the gripper arms engage the uneven surfaces of the bore, ball 45, shown more clearly in FIG. 4, of hub 44 pivots within socket 46 of bushing 60. As heretofore described, this free floating motion allows the gripper assembly 11 to pivot 360° about the longitudinal X—X axis of the refractory portion 2*b* and securely seat the gripper arms against the uneven bore surfaces.

Figure 11:
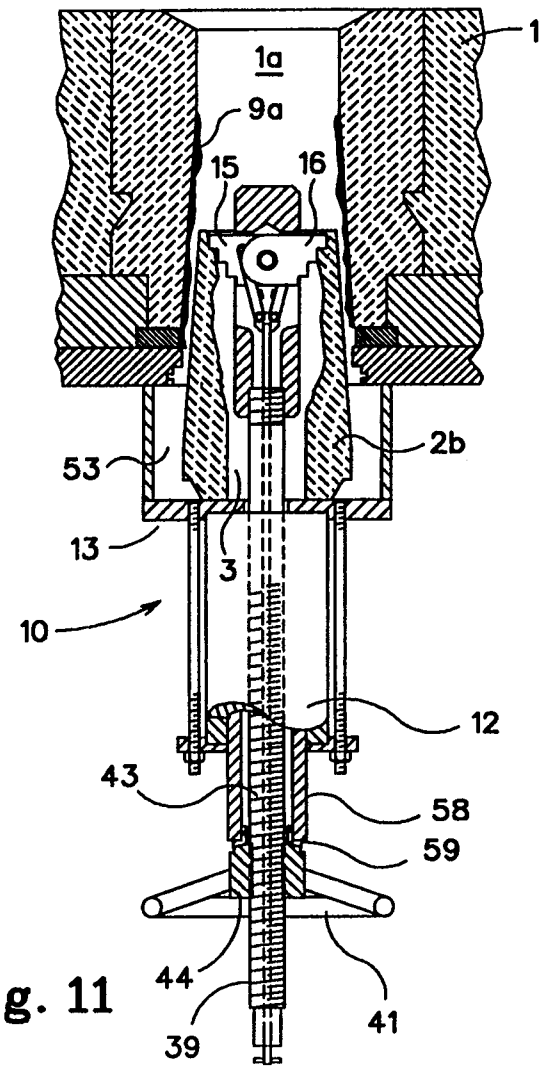

As further shown in FIG. 11, after the gripper arms have been securely seated within the worn discharge bore, a hydraulic pump (not shown) is started to apply a force to extend plunger 58 of the drive means 12. As the plunger is forced in an outward direction away from the steelmaking ladle, it drives the gripper assembly outward. This causes the seated gripper arms 15 and 16 to exert an outward force upon the refractory portion 2*b*, break the mortar bond 9*a* between the insert and the ladle discharge bore 1*a*, and pull the refractory portion 2*b* into the worn nozzle container 53.

While we have described and shown the preferred embodiment of our invention, it should be understood that various other embodiments may be devised within the scope of the invention. For example, although the preferred embodiment describes using a double acting, hollow plunger hydraulic cylinder, it should be understood that other power drive arrangements may be used without departing from the scope of this invention. And additionally, although we have shown and described .the preferred nozzle extraction tool as being suited for extracting a one piece refractory insert 2*b*, it should be understood that the nozzle extraction tool invention is also suited for extracting multi-pieced refractory inserts without departing from the scope of this invention.

We claim:

1. A nozzle extraction tool for removing a nozzle insert from a steelmaking vessel comprising;

a) a support frame including a drive means, b) a gripper assembly including a housing and at least two gripper arms pivotally fastened to said housing, c) linkage for rotating said at least two gripper arms to extended or retracted positions, said linkage pivotally fastened to said at least two gripper arms and extending through a conduit attached to said housing, and d) a gripper assembly adjustment means including a hub having a threaded bore engaging a threaded end portion of said conduit, said hub having an end portion adapted to engage said drive means and provide a flexible coupling to manipulate said gripper assembly about a longitudinal X—X axis of said nozzle insert.

2. The invention as described in claim 1 wherein said flexible coupling includes a ball end extending from said hub and a socket formed within said drive means, said socket being adapted to receive said ball end.

3. The invention described in claim 2 wherein said socket is adapted to demountably engage said ball end.

4. The invention as described in claim 3 wherein said flexible coupling is capable of pivoting about said X—X axis.

5. The invention as described in claim 3 wherein said flexible coupling is capable of rotating about said X—X axis.

6. The invention described in claim 3 wherein said flexible coupling is capable of both pivoting and rotating about said X—X axis.

7. The invention as described in claim 1 wherein said gripper assembly includes a pivot pin extending through apertures provided within said at least two gripper arms, said pivot pin being fastened within an inside chamber formed by a slot extending through said housing.

8. The invention described in claim 7 wherein said conduit communicates with said inside chamber of said gripper assembly housing.

9. The invention as described in claim 8 wherein said linkage includes at least two link straps, each link strap having a first end pivotally attached to a push rod extending through said conduit and a second end pivotally attached to a gripper arm.

10. The invention as described in claim 9 wherein at least one link strap includes a stop plate positioned to strike a second stop plate when said at least two gripper arms are rotated to a closed position.

11. The invention as described in claim 10 wherein said second stop plate is fastened to a second link strap.

12. The invention as described in claim 7 wherein at least one gripper arm includes a surface positioned to strike a wall of said inside chamber when said at least two gripper arms to a closed position.

13. The invention as described in claim 7 wherein at least one said gripper arm includes a surface positioned to strike a wall of said inside chamber when said at least two gripper arms are rotated to an open position.

14. The invention as described in claim 1 wherein said means to align said nozzle extraction tool includes two or more alignment pins extending in an outward direction from said support frame, said alignment pins corresponding with apertures within said ladle, said alignment pins and said apertures being arranged to coaxially align said support frame with said nozzle insert.

15. The invention as described in claim 1 wherein said means to align said nozzle extraction tool includes a recessed shoulder formed within said ladle, said recessed shoulder conforming to the periphery of said support frame.

16. The invention as described in claim 1 wherein said support frame includes a container for receiving an extracted nozzle insert.

17. The invention as described in claim 2 wherein said drive means includes a plunger having a bushing, said bushing including said socket adapted to receive said ball end extending from said hub.

18. A method for removing a nozzle insert from a discharge bore of a steelmaking vessel, the steps comprising;

a) disengaging and removing a nozzle insert lock means from said discharge bore, b) aligning a nozzle extraction tool with said nozzle insert positioned within said discharge bore, said nozzle extraction tool comprising, i) a support frame including a drive means, ii) a gripper assembly including a housing and at least two gripper arms pivotally fastened to said housing, iii) linkage for rotating said at least two gripper arms to extended or retracted positions, said linkage pivotally fastened to said at least two gripper arms and extending through a conduit attached to said housing, and iv) a gripper assembly adjustment means including a hub having a threaded bore engaging a threaded end portion of said conduit said hub having an end portion adapted to engage said drive means, where said engaged hub and drive means provide a flexible coupling to manipulate said gripper assembly about a longitudinal X—X axis of said nozzle insert.

c) inserting said gripper assembly into a bore extending through said nozzle insert, d) rotating said at least two gripper arms to an open position to engage said nozzle insert, e) applying a force against said adjustment means to cause said gripper assembly to pivot about said X—X axis and seat said at least two gripper arms against said nozzle insert, f) applying a force against said adjustment means to cause said gripper assembly to withdraw from said discharge bore and remove said nozzle insert from said steelmaking vessel.

19. The method described in claim 18 wherein said hub is rotated to apply said force to cause said gripper assembly to pivot and seat said at least two gripper arms against said nozzle insert.

20. The method described in claim 18 wherein a plunger of said drive means is extended to apply said force to withdraw said gripper arm assembly from said discharge bore.

21. A method for removing a nozzle insert from a discharge bore of a steelmaking vessel, the steps comprising;

a) disengaging and removing a nozzle insert lock from said discharge bore, b) aligning a nozzle extraction tool, having a gripper assembly, with said discharge bore, c) inserting said gripper assembly, having a friction engaging means, into a cavity within said nozzle insert positioned within said discharge bore.

d) engaging said friction engaging means with surfaces of said nozzle insert, e) applying a force to cause said gripper assembly to pivot about a longitudinal X—X axis extending through said discharge bore and seat said friction engaging means against said surfaces of said nozzle insert, said force causing said nozzle gripper assembly to withdraw from said discharge bore and remove said nozzle insert from said discharge bore.

* * * * *